US005138289A

United States Patent [19]

McGrath

[11] Patent Number: 5,138,289

[45] Date of Patent: Aug. 11, 1992

[54] NONCONTACTING WAVEGUIDE BACKSHORT

[75] Inventor: William R. McGrath, Monrovia, Calif.

[73] Assignee: California Institute of Technology, Pasadena, Calif.

[21] Appl. No.: 631,639

[22] Filed: Dec. 21, 1990

[51] Int. Cl.[5] ..... H01P 1/28

[52] U.S. Cl. ..... 333/253; 333/248

[58] Field of Search ..... 333/209, 248, 253, 263

[56] References Cited

U.S. PATENT DOCUMENTS

| | | | |
|---|---|---|---|
| 2,543,721 | 2/1951 | Collard et al. | 333/253 X |
| 2,675,524 | 4/1954 | Collard | 333/253 |
| 4,216,450 | 8/1980 | Linke et al. | 333/253 X |
| 4,800,349 | 1/1989 | Gurcan et al. | 333/248 X |

OTHER PUBLICATIONS

McGrath et al, "Development of a 600–700 GHz SIS Receiver", *Symposium proceedings, First Int'l Symposium on Space Terahertz Technology*, pp. 409–433, Mar. 1990.

Brewer et al, "Dual-Harmonic Noncontacting Millimeter Waveguide Backshorts: Theory, Design, and Test" *IEEE Transactions on Microwave Theory and Techniques*, pp. 708–714, 1982.

*Primary Examiner*—Paul Gensler

*Attorney, Agent, or Firm*—Norman E. Brunell

[57] ABSTRACT

A noncontacting waveguide backshort is provided for use with frequencies of interest between 1 and 1000 GHz including a relatively rugged metallic bar movably mounted within the waveguide in a MYLAR insulator. A series of regularly shaped and spaced circular or rectangular openings are made in the metallic bar to form sections of high impedance alternating with sections of the bar having low impedance. This creates a periodic impedance variation which serves to provided an adjustable short circuit in a waveguide for the frequencies of interest.

20 Claims, 1 Drawing Sheet

NONCONTACTING WAVEGUIDE BACKSHORT

ORIGIN OF THE INVENTION

The invention described herein was made in the performance of work under a NASA contract, and is subject to the provisions of Public Law 96-517 (35 USC 202) in which the Contractor has elected to retain title.

BACKGROUND OF THE INVENTION

1. Field of the Invention

The present invention relates to adjustable backshorts for making variable length waveguide stubs by producing short circuits in the waveguides at high frequencies. In particular, this invention relates to non-contacting backshorts for use with frequencies in the 1 to 1000 GHz range.

2. Description of the Prior Art

Conventional waveguide systems utilize adjustable short circuits to tune the waveguides and produce more complex waveguide components. At higher frequencies, contacting backshorts—as described below with reference to FIG. 1—are normally used because of the very small physical dimensions of the waveguides. The contact area in such backshorts is critical and must make good contact to produce an acceptable short circuit. These backshorts provide good short circuits over the entire waveguide band.

However, the contacting areas of such waveguides eventually degrade from sliding friction. It is often difficult to achieve and maintain a uniform contact between the backshort and the waveguide walls at higher frequencies where the waveguide dimensions become fractions of a millimeter.

Some of these limitations have been overcome by the development of noncontacting backshorts, which are described in more detail with reference to FIG. 2 below. Noncontacting backshorts use a thin insulator of plastic film sold under the trademark "MYLAR" to prevent contact between the backshort and the waveguide and to permit the backshort to slide smoothly therein without appreciable wear.

Such noncontacting backshorts utilize a series of high and low impedance sections in order to produce a good radio frequency, or rf, short circuit and therefore a large reflection. The series of high and low impedance sections are typically placed at $\lambda_g/8$ to $\lambda_g/4$ in length, where $\lambda_g$ is the wavelength in the waveguide.

However, at very high frequencies above 100 GHz, the thin high impedance sections become too thin to easily fabricate and the conventional noncontacting backshort is no longer strong enough to slide snugly in the waveguide.

What is needed is a backshort for producing short circuits in waveguides that has the advantages of noncontacting waveguides but is sufficiently rugged and easy to fabricate for use at high frequencies in the range of 1 to 1000 GHz.

SUMMARY OF THE INVENTION

The preceding and other shortcomings of the prior art are addressed and overcome by the present invention that provides, in a first aspect, a method of tuning a waveguide stub by snugly mounting a metallic bar for motion in a waveguide sized for use with frequencies of interest between 1 and 1000 GHz, insulating the bar from the waveguide, and forming an adjustable short circuit in the waveguide with a series of openings through the metallic bar creating sections of high impedance alternating with sections of the bar having low impedance.

In another aspect, the invention provides a tunable waveguide stub, including a waveguide sized for use with frequencies of interest between 1 and 1000 GHz, a thin insulator in the waveguide, a metallic bar movably mounted within the waveguide and insulated therefrom by the insulator, and a series of openings through the metallic bar forming sections of high impedance alternating with sections of the bar having low impedance to provide an adjustable short circuit in the waveguide for the frequencies of interest.

The foregoing and additional features and advantages of this invention will become further apparent from the detailed description and accompanying drawing figure or figures that follow. In the figures and written description, numerals indicate the various features of the invention, like numerals referring to like features throughout both the drawing figures and the written description.

DETAILED DESCRIPTION OF THE PREFERRED EMBODIMENT

Figure 2:
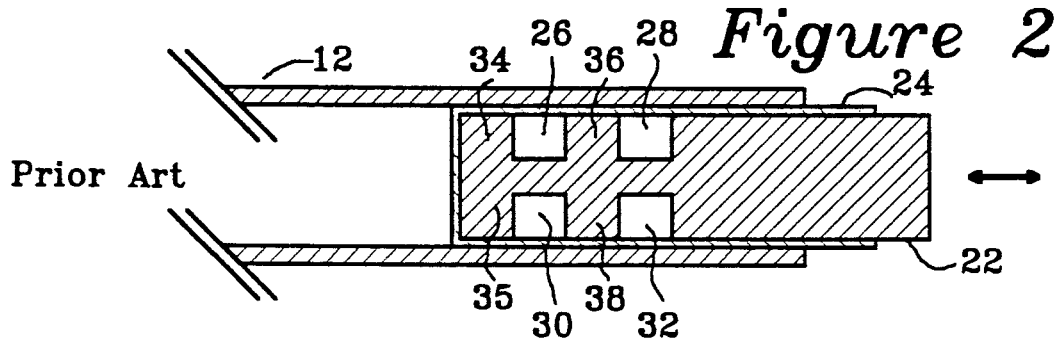
FIG. 2 is a cross sectional view of a conventional noncontacting backshort in a waveguide.

Referring now to FIG. 2, conventional contacting waveguide backshort 10 is shown in cross section within waveguide stub 12. Backshort 10 is movable within waveguide stub 12 to tune the length of stub 12 by providing a short circuit between waveguide walls 14 and 16 at contact points 18 and 20.

Referring now to FIG. 2, conventional noncontacting waveguide backshort 22 is shown in cross section within waveguide stub 12. Non-contacting waveguide backshort 22 is also movable to tune the length of waveguide stub 12. Noncontacting waveguide backshort 22 is isolated from waveguide stub 12 by a thin MYLAR insulator, such as insulator 24. Insulator 24 prevents contact between noncontacting waveguide backshort 22 and waveguide stub 12 and permits noncontacting waveguide backshort 22 to slide smoothly therein, without altering the characteristics of the short circuit by degrading a contact surface.

In order to produce an acceptable rf short circuit, noncontacting waveguide backshort 22 includes a series of high impedance and low impedance sections such as high impedance sections 26, 28, 30 and 32 which are interspersed between low impedance or conducting sections of backshort 22, such as low impedance sections 34, 35, 36 and 38. High and low impedance sections 26, 28, 30 32, 34, 36 and 38 are typically about $\lambda_g/8$ to $\lambda_g/4$ in length.

High impedance sections 26, 28, 30 and 32 are slots cut in waveguide backshort 22 which produce an effective waveguide height of about 30% to 40% of full height. Such slots provide a relatively high impedance because waveguide impedance is proportional to waveguide height. Low impedance sections 34, 35, 36 and 38 substantially reduce the waveguide height and therefore provide a low impedance.

This periodic guide impedance variation is known to provide a large reflection and therefore a good short circuit. The rf impedance, $Z_{rf}$, of backshort 22 is given approximately by:

$$Z_{rf} = \left(\frac{Z_{low}}{Z_{high}}\right)^n Z_{low}, \quad (1)$$

where $Z_{low}$ is the waveguide impedance of low impedance sections 34, 36 and 38, $Z_{high}$ is the impedance of high impedance sections 26, 28, 30 and 32 and n is the number of sections, if n is an even number. Values of $Z_{rf}$ less than 1 ohm are predicted which provides a good short circuit.

Waveguide stub 12 is typically a hollow tube with a rectangular cross section. In the 300–600 GHz band, the dimensions of the rectangular cross section of waveguide stub 12 are on the order of 500 μm ×250 μm. At these high frequencies, high impedance sections 26, 28, 30 and 32 become too thin to fabricate and conventional noncontacting waveguide backshort 22 is no longer strong enough to slide snugly in waveguide stub 12. This is a serious limitation because it limits the development of waveguide circuits for high frequencies.

Figure 3:
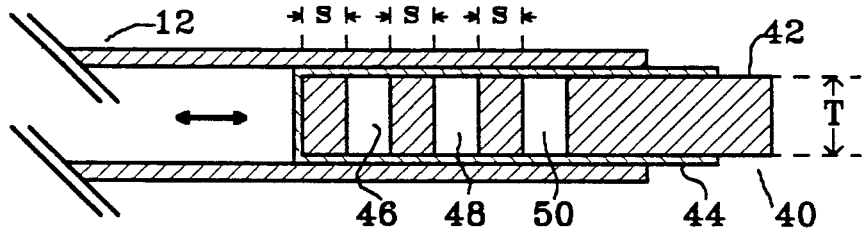
FIG. 3 is a cross sectional view of a noncontacting backshort in a waveguide in accordance with the present invention.
Figure 4:
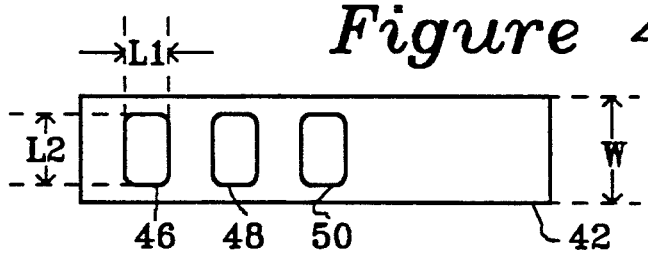
FIG. 4 is a plan view of one embodiment of the backshort of the present invention using generally rectangular holes.
Figure 5:
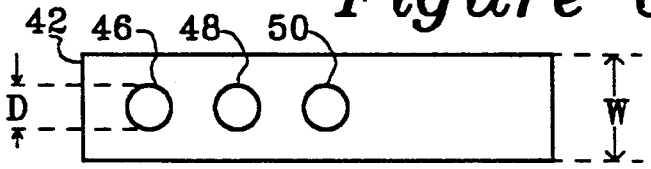
FIG. 5 is a plan view of another embodiment of the backshort of the present invention using circular holes.

A more rugged alternative is provided by the present invention, as shown in FIGS. 3 through 5.

Referring now to FIG. 3, noncontacting waveguide backshort 40 is shown in cross section view. In accordance with the present invention, noncontacting waveguide backshort 40 includes low impedance, metallic bar 42 sheathed within MYLAR insulator 44. Insulator 44 serves the same general purpose as insulator 24, shown in FIG. 2. The thickness T of metallic bar 42 is chosen so that, together with MYLAR insulator 44, they will fit snugly, but movably, within waveguide stub 12.

The equivalent of the periodic impedance variations provided by high and low impedance sections 26, 28, 30, 32, 34, 35, 36 and 38 of conventional backshort 22 shown in FIG. 2 are provided by holes 46, 48 and 50 in low impedance, metallic bar 42 in accordance with the present invention. Holes 46, 48 and 50 are spaced apart an equal spacing distance S which provides a portion of low impedance metallic bar 42 between each high impedance hole.

The power in a fundamental mode waveguide is proportional to $\sin^2(x)$ where x is the coordinate transverse to the waveguide axis, such as the width variable W shown in FIG. 4. Most of the power traveling along waveguide stub 12 is therefore concentrated near the center of waveguide stub 12. Holes 46, 48 and 50 do not need to extend to the edges of metallic bar 42 in order to intercept most of the fundamental mode waveguide power. Holes 46, 48 and 50 are therefore able to provide the necessary high impedance variation and thus provide a large reflection of RF power. In addition, holes 46, 48 and 50 extend all the way through metallic bar 42 thus providing a higher ratio between high and low impedance than is provided by the conventional design shown in FIG. 2.

The alternating sections of low impedance, metallic bar 42 surrounding the effectively high impedance of holes 46, 48 and 50 provides an easily controllable, easily manufacturable and relatively rugged backshort suitable for use at higher frequencies, in the range of 1 to 1000 GHz. In accordance with a preferred embodiment of the present invention, holes 46, 48 and 50 may be smoothed rectangular holes in low impedance, metallic bar 42 as shown in FIG. 4, or circular holes as shown in FIG. 5.

As noted above, metallic bar 42 is dimensioned to form a snug fit in waveguide stub 12 with MYLAR insulator 44. For high frequencies, above a few hundred GHz, metallic bar 42 may be fabricated from a piece of shim stock, polished to the correct thickness. Holes 46, 48 and 50 may be formed in metallic bar 42 by drilling, punching or can be etched using common fabrication techniques.

The size of holes 46, 48 and 50 and the spacing S therebetween in metallic bar 42 may be determined in accordance with known procedures for determining such dimensions for conventional noncontacting waveguide backshorts, such as noncontacting waveguide backshort 22 shown in FIG. 2. The lengths of the alternating high and low impedance sections are typically between about $\lambda_g/8$ and $\lambda_g/4$.

A particular physical embodiment of the present invention as shown in FIGS. 3 and 4 will next be described as an example. Waveguide stub 12 would have a rectangular cross section of 47.5 mm ×22.1 mm. The width and thickness dimensions of metallic bar 42 would be W=47.5 mm and T=19.7 mm, respectively. The thickness of MYLAR insulator 44 would be 1.02 mm. The dimensions of rectangular holes 46, 48 and 50, as shown in FIG. 4, would be $L_1$=19.3 mm and $L_2$=28.4 mm with a spacing between the holes of S=8.7 mm.

In an experimental setup up based upon the above described example of metallic bar 42, the center frequency was found to be 3.87 GHz. This implies that the high impedance section lengths were $L_1=0.158\ \lambda_g$ while the low impedance sections lengths were $S=0.144\ \lambda_g$. The presence of MYLAR insulator 44 modifies the waveguide modes.

In an experimental setup based upon the embodiment shown in FIG. 5 using circular holes, the diameter of the holes were D=19.3 mm with a spacing of S=8.7 mm. The dimensions of metallic bar 42 were W=47.5 mm ×T=19.7 mm. The thickness of MYLAR insulator 44 was 0.89 mm. The center frequency was 4.3 GHz, implying high impedance section lengths of $D=0.199\ \lambda_g$ and low impedance sections lengths of $S=0.150\ \lambda_g$.

While this invention has been described with reference to its presently preferred embodiments, its scope is not limited thereto. Rather, such scope is only limited in so far as defined by the following set of claims and includes all equivalents thereof.

What is claimed is:

1. A tunable waveguide stub, comprising:

a waveguide sized for use with frequencies of interest between 1 and 1000 GHz;

a thin insulator in the waveguide;

a metallic bar movably mounted within the waveguide and insulated therefrom by the insulator; and a series of openings completely through the metallic bar forming sections of high impedance alternating with sections of the bar having low impedance to provide an adjustable short circuit in the waveguide for the frequencies of interest.

2. The tunable waveguide stub claimed in claim 1, wherein the openings each form a section of high impedance having a length equivalent to a portion of a wavelength at the frequencies of interest.

3. The tunable waveguide stub claimed in claim 1, wherein the openings each form a section of high impedance having a length equivalent to substantially the same portion of a wavelength at the frequencies of interest.

4. The tunable waveguide stub claimed in claim 1, wherein the openings are regularly shaped and spaced.

5. The tunable waveguide stub claimed in claim 4, wherein the sections of high impedance formed by each opening are in the range of about one eighth to one quarter wavelength at the frequencies of interest.

6. The tunable waveguide stub claimed in claim 5, wherein the sections of high impedance formed by each opening are on the order of one eighth wavelength at the frequencies of interest.

7. The tunable waveguide stub claimed in claim 6, wherein the openings are circular.

8. The tunable waveguide stub claimed in claim 6, wherein the openings are rectangular.

9. The tunable waveguide stub claimed in claim 4, wherein the sections of low impedance formed by the portion of the bar between each opening are in the range of about one eighth to one quarter wavelength at the frequencies of interest.

10. The tunable waveguide stub claimed in claim 9, wherein the sections of low impedance formed by the portion of the bar between each opening are on the order of one eighth wavelength at the frequencies of interest.

11. A method of tuning a waveguide stub, comprising the steps of:

snugly mounting a metallic bar for motion in a waveguide sized for use with frequencies of interest between 1 and 1000 GHz;

insulating the bar from the waveguide; and forming an adjustable short circuit in the waveguide with a series of openings completely through the metallic bar creating sections of high impedance alternating with sections of the bar having low impedance.

12. The method of tuning a waveguide stub claimed in claim 11, wherein the openings each form a section of high impedance having a length equivalent to a portion of a wavelength at the frequencies of interest.

13. The method of tuning a waveguide stub claimed in claim 11, wherein the openings each form a section of high impedance having a length equivalent to substantially the same portion of a wavelength at the frequencies of interest.

14. The method of tuning a waveguide stub claimed in claim 11, wherein the openings are regularly shaped and spaced.

15. The method of tuning a waveguide stub claimed in claim 14, wherein the sections of high impedance formed by each opening are in the range of about one eighth to one quarter wavelength at the frequencies of interest.

16. The method of tuning a waveguide stub claimed in claim 15, wherein the sections of high impedance formed by each opening are on the order of one eighth wavelength at the frequencies of interest.

17. The method of tuning a waveguide stub claimed in claim 16, wherein the openings are circular.

18. The method of tuning a waveguide stub claimed in claim 16, wherein the openings are rectangular.

19. The tunable waveguide stub claimed in claim 14, wherein the sections of low impedance formed by the portion of the bar between each opening are in the range of about one eighth to one quarter wavelength at the frequencies of interest.

20. The tunable waveguide stub claimed in claim 19, wherein the sections of low impedance formed by the portion of the bar between each opening are on the order of one eighth wavelength at the frequencies of interest.

* * * * *

UNITED STATES PATENT AND TRADEMARK OFFICE

CERTIFICATE OF CORRECTION

PATENT NO. : 5,138,289

DATED : August 11, 1992

INVENTOR(S) : William R. McGrath

It is certified that error appears in the above-identified patent and that said Letters Patent is hereby corrected as shown below:

Abstract, line 9, after "which serves to" change "provided" to -- provide --.

Figure 1:
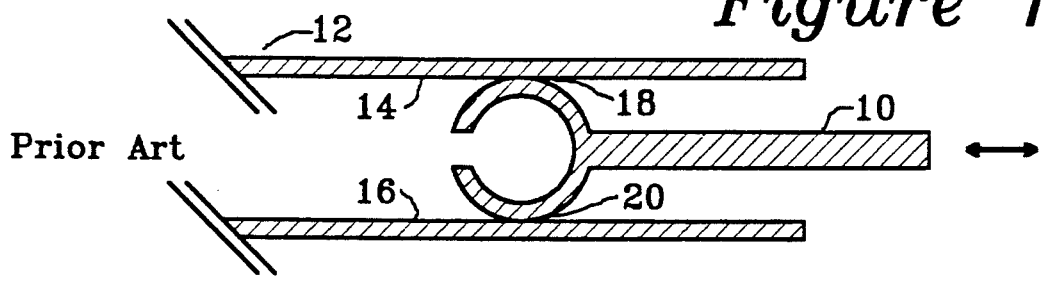
FIG. 1 is a cross sectional view of a conventional contacting backshort in a waveguide.

Column 2, line 40, after "Referring now to" replace "Fig. 2" with -- Fig. 1 --.

Column 3, line 20, before "than" replace "$Z_{rf}$less" with -- $Z_{rf}$ less --.

Signed and Sealed this

Nineteenth Day of October, 1993

Bruce Lehman

*Attest:*

BRUCE LEHMAN

*Attesting Officer*

*Commissioner of Patents and Trademarks*